United States Patent [19]

Rippelmeyer

[11] 4,435,150

[45] Mar. 6, 1984

[54] GAS BURNER CONTROL SYSTEM

[75] Inventor: Dennis M. Rippelmeyer, Waterloo, Ill.

[73] Assignee: Emerson Electric Co., St. Louis, Mo.

[21] Appl. No.: 421,299

[22] Filed: Sep. 22, 1982

[51] Int. Cl.[3] ..... F23Q 9/14

[52] U.S. Cl. ..... 431/46; 431/42; 431/43; 431/60; 431/66; 431/75

[58] Field of Search ..... 431/43, 46, 66, 60, 431/75, 42

[56] References Cited

U.S. PATENT DOCUMENTS

| | | | |
|---|---|---|---|
| 3,853,455 | 12/1974 | Riordan et al. | 431/80 |
| 4,019,854 | 4/1977 | Carlson et al. | 431/80 |
| 4,231,732 | 11/1980 | Newport, Jr. et al. | 431/46 |
| 4,269,589 | 5/1981 | Matthews | 431/24 |
| 4,298,335 | 11/1981 | Riordan et al. | 431/25 |

FOREIGN PATENT DOCUMENTS

| | | | |
|---|---|---|---|
| 56-30535 | 3/1981 | Japan | 431/66 |

*Primary Examiner*—Samuel Scott
*Assistant Examiner*—Helen A. Odar
*Attorney, Agent, or Firm*—Paul A. Becker, Sr.

[57] ABSTRACT

Upon a call for heat, gas flows to a pilot burner, a spark generating circuit is energized to ignite the pilot burner, and an oscillator is energized. When flame appears, the output signal of the oscillator is effective, through flame responsive means including capacitor means and solid-state switch means, to enable energizing of the primary winding of a coupling transformer at the frequency of the oscillator signal. When so energized, sufficient power transfer occurs between the primary and secondary windings of the coupling transformer to enable energizing of a relay winding, which energizing terminates energizing of the spark generating circuit and allows gas to flow to the main burner.

12 Claims, 1 Drawing Figure

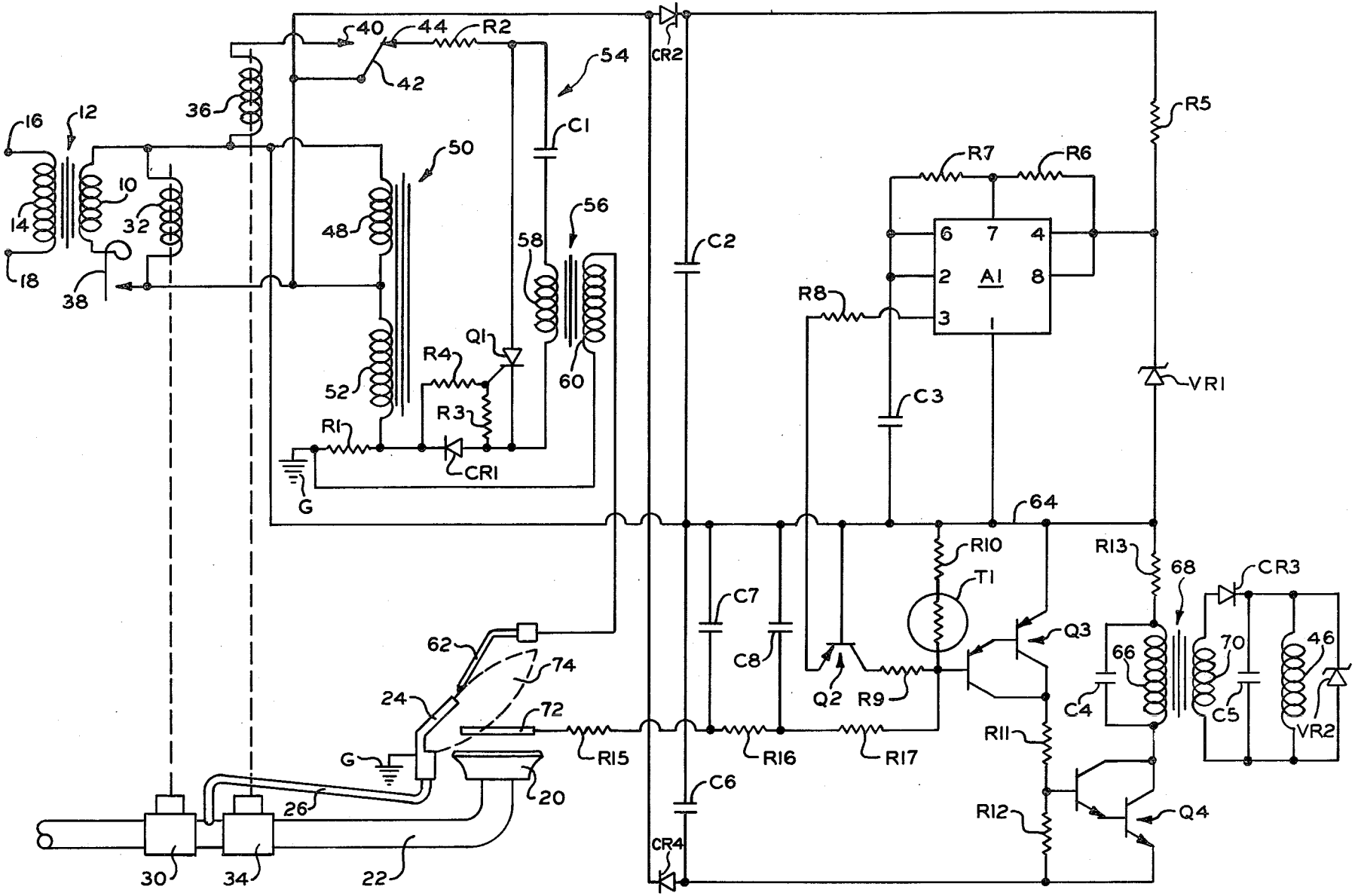
R5
VR1
R6
R7
A1
4
8
7
1
6
2
3
C3
R8
64
68
R13
66
C4
CR3
46
VR2
70
C5
Q4
Q3
R10
T1
R11
R12
R9
R17
Q2
C8
C7
R16
C2
C6
CR2
CR4
54
C1
56
60
58
R2
Q1
CR1
R4
R3
50
44
42
40
48
52
R1
G
R15
74
72
20
62
24
22
26
34
30
36
32
10
38
12
16
14
18

GAS BURNER CONTROL SYSTEM

BACKGROUND OF THE INVENTION

This invention relates to burner control systems for fluid fuel burners and particularly, to gas burner control systems wherein, upon a call for heat, a pilot burner flame is established and a main burner is subsequently ignited by the pilot burner flame.

Due to the increasing need for conservation of energy, many different types of burner control systems which eliminate the conventional standing-pilot have been proposed. Among such proposed systems are some which retain the pilot burner but provide for ignition of the pilot burner only when there is a call for heat. Such systems thus retain the proven reliability of igniting a main burner with a pilot burner flame but eliminate the waste of gas inherent in a conventional standing-pilot system.

A safety requirement of those systems wherein the pilot burner is ignited only when there is a call for heat is that gas be allowed to flow to the main burner only when a pilot burner flame exists. When the means used to sense the pilot burner flame and respond to it is electronic, meeting this requirement is complicated by factors which tend to falsely indicate the existence of a pilot burner flame, such factors including failure of a circuit component, excessive dirt or humidity on the flame sensing probe, and false signals or noise introduced into the circuitry.

SUMMARY OF THE INVENTION

An object of the present invention is to provide a generally new and improved gas burner control system having a pilot burner ignited only upon a call for heat and electronic circuit means for sensing the existence of the pilot burner flame and subsequently enabling gas to flow to a main burner, which system is particularly reliable, simple, and economical to construct.

This and other objects and features of the present invention will become apparent from the following description when read in conjunction with the accompanying drawing.

BRIEF DESCRIPTION OF THE DRAWING

The single FIGURE of the drawing is a schematic illustration of a gas burner control system constructed in accordance with the present invention.

DESCRIPTION OF THE PREFERRED EMBODIMENT

Referring to the single FIGURE of the drawing, the gas burner control system is adapted to be energized by the secondary winding 10 of a 120/24 volt step-down transformer 12 which has its primary winding 14 connected across terminals 16 and 18 of a conventional 120 volt, 60 Hz alternating current power source.

A main burner 20 is supplied with gas from a gas source through a conduit 22. Mounted adjacent main burner 20 is a pilot burner 24 connected by a conduit 26 to conduit 22. Pilot burner 24 is constructed of electrically conductive material and is grounded at G.

A first electromagnetically operated valve 30 having a winding 32 and a second electromagnetically operated valve 34 having a winding 36 are interposed in series flow relationship in conduit 22. The conduit 26 leading to pilot burner 24 is connected to conduit 22 between valves 30 and 34. When only valve 30 is open, gas flows only to pilot burner 24; when both valves 30 and 34 are open, gas also flows to main burner 20. While valves 30 and 34 are shown as separate valves, it is to be understood that they may be combined into a single device.

Winding 32 of valve 30 is connected across transformer secondary winding 10 through a thermostat 38. Winding 36 of valve 34 is connected across transformer secondary winding 10 through thermostat 38 and through a normally-open fixed contract 40 and a movable contact 42 of an electromagnetically operated relay also having a normally-closed fixed contact 44 and a controlling winding 46.

Connected across transformer secondary winding 10 through thermostat 38 is a first winding portion 48 of an autotransformer 50. One end of a second winding portion 52 of autotransformer 50 is connected to first winding portion 48 and the other end is connected through a current-limiting resistor R1 to ground at G. Autotransformer 50 is constructed so that the voltage across the first winding portion 48 is 24 volts, the voltage across the second winding portion is 120 volts, and the voltage across both windings is cumulative at 144 volts.

A conventional spark generating circuit is shown at 54. Included in circuit 54 is a voltage step-up transformer 56 comprising a primary winding 58 and a secondary winding 60. Primary winding 58 is connected to one side of the autotransformer second winding portion 52 through a storage capacitor C1, a current-limiting resistor R2, and relay contacts 42 and 44, and to the other side of the second winding portion 52 through a controlled rectifier or diode CR1. Connected in parallel with the series-connected capacitor C1 and primary winding 58 is an SCR (silicon controlled rectifier) Q1. The anode of SCR Q1 is connected between capacitor C1 and resistor R2, and the cathode thereof is connected between primary winding 58 and rectifier CR1. A resistor R3 is connected between the gate of SCR Q1 and the anode of rectifier CR1, and a resistor R4 is connected between the gate of SCR Q1 and the cathode of rectifier CR1. One end of secondary winding 60 is connected to ground at G, and the other end thereof is connected to a spark electrode 62 positioned in spark producing relationship with pilot burner 24.

Spark generating circuit 54 is effective to provide sparking between electrode 62 and pilot burner 24 at a rate of 60 sparks per second. Specifically, when thermostat 38 is closed and relay contacts 42 and 44 are connected, capacitor C1 is charged through rectifier CR1 when the top end, as viewed in the drawing, of autotransformer second winding portion 52 is positive. After the voltage across second winding portion 52 peaks and begins to decrease, capacitor C1 begins to discharge through resistors R4 and R3 and the gate and cathode of SCR Q1, turning on SCR Q1. WIth SCR Q1 on, capacitor C1 rapidly discharges through SCR Q1 and primary winding 58 of transformer 56, causing a voltage of approximately 15,000 volts to be induced in secondary winding 60 which effects a spark between electrode 62 and pilot burner 24. When the voltage across second winding portion 52 reverses, capacitor C1 is charged in the opposite polarity as before, but at a much slower rate due to resistors R4 and R3 being in the charging circuit. During this reverse cycle, the cathode of SCR Q1 is more positive than the anode thereof, so that SCR Q1 is off and no sparking occurs.

Also connected across transformer secondary winding 10 through thermostat 38 is an oscillator A1 which is a timer chip connected so as to function as a free-running multivibrator or oscillator. An input pin 8 of oscillator A1 is connected through a resistor R5 and a controlled rectifier CR2 to one side of transformer secondary winding 10 (through thermostat 38), and a common pin 1 of oscillator A1 is connected to a lead 64 which is connected to the other side of transformer secondary winding 10. A filter capacitor C2 is connected between the cathode of rectifier CR2 and lead 64, and a voltage regulator VR1 is connected between input pin 8 and lead 64 to establish a desired voltage level of approximately 12 volts for oscillator A1. Resistor R5 limits the current flow through regulator VR1.

A resistor R6 is connected between pins 4 and 7 of oscillator A1, a resistor R7 is connected between pins 6 and 7, and a capacitor C3 is connected between pin 2, which is commonly connected with pin 6, and lead 64. The values of resistors R6 and R7 and capacitor C3 are such that the output of oscillator A1 at its output pin 3 is a square wave signal of 0 to approximately 6 volts at a frequency of approximately 1500 Hz.

The output pin 3 of oscillator A1 is connected through a current-limiting resistor R8 to the emitter of a PNP transistor Q2. The base of transistor Q2 is connected to lead 64. The collector of transistor Q2 is connected through a current-limiting resistor R9 to the base of a PNP small signal Darlington transistor Q3.

The emitter of transistor Q3 is connected to lead 64. The base of transistor Q3 is connected through an NTC (negative temperature coefficient) thermistor T1 and a resistor R10 to lead 64. Thermistor T1 ensures reliable system operation at low ambient temperatures. Specifically, at a low ambient temperature, such as −40° F., transistor Q3 requires more emitter-base current to enable turn-on than it does at high ambient temperatures. Since thermistor T1 is an NTC type, it exhibits a relatively high resistance at low temperatures, enabling more of the available biasing current to flow through the emitter-base of transistor Q3. At high ambient temperatures, the resistance of thermistor T1 is relatively low and resistor R10 provides the proper bias for transistor Q3.

The collector of transistor Q3 is connected through a resistor R11 to the base of an NPN power Darlington transistor Q4. A bias resistor R12 is connected between the base and emitter of transistor Q4.

Connected in series between the collector of transistor Q4 and lead 64 are a current-limiting resistor R13 and the primary winding 66 of a coupling transformer 68. Connected in parallel with primary winding 66 is a capacitor C4. The secondary winding 70 of coupling transformer 68 is connected through a controlled rectifier CR3 to a capacitor C5. Connected in parallel with capacitor C5 is relay winding 46 which controls relay contacts 40, 42, and 44. Also connected in parallel with capacitor C5 is a voltage regulator VR2 which limits the voltage across relay winding 46 to 12 volts.

One side of a capacitor C6 is connected to lead 64 which is connected to one end of transformer secondary winding 10. The other side of capacitor C6 is connected to the emitter of transistor Q4 and through a controlled rectifier CR4 and thermostat 38 to the other end of transformer secondary winding 10. When thermostat 38 is closed, capacitor C6 is charged by transformer secondary winding 10.

A flame probe 72 is positioned near pilot burner 24 so as to be enveloped by the pilot burner flame indicated at 74. One side of a capacitor C7 is connected through a resistor R15 to the flame probe 72, and the other side thereof to lead 64. When the pilot burner flame 74 exists, capacitor C7 is charged by the 144 volt output of autotransformer 50, the circuit being: from the top end of first winding portion 48, through lead 64, capacitor C7, resistor R15, probe 72, flame 74, pilot burner 24, ground G, and resistor R1 to the bottom end of second winding portion 52.

The side of capacitor C7 connected to resistor R15 is also connected through resistors R16 and R17 to the base of transistor Q3. When C7 discharges, the discharge path is through the emitter and base of transistor Q3 and resistors R17 and R16. The resistance value of resistor R15 is quite large so as to limit the charging current to capacitor C7 in the event that probe 72 is shorted to pilot burner 24. The resistance value of resistor R17 is several times larger than that of resistor R15 to ensure that capacitor C7 does not discharge at a rate faster than it can charge.

One side of a capacitor C8 is connected to lead 64 and the other side thereof to a point between resistors R16 and R17. Capacitor C8 functions in the same manner as capacitor C7. The provision of two capacitors ensures reliable system operation in the event that one of them should become defective.

The following circuit components have been found to be suitable for use in the system described herein.

| COMPONENT | TYPE |
|---|---|
| A1 | NE555 |
| T1 | 100K at 25° C. NTC |
| VR1, 2 | IN5243 |
| CR1, 2, 3, 4 | IN4004 |
| C1 | 1 Mfd. |
| C2, C5 | 47 Mfd. |
| C3 | .0033 Mfd. |
| C4 | .1 Mfd. |
| C6 | 220 Mfd. |
| C7, 8 | .015 Mfd. |
| Q1 | C106B |
| Q2 | MPS3906 |
| Q3 | MPSA76 |
| Q4 | TIP110 |
| R1 | 1M |
| R2, 3, 5, 8 | 1K |
| R4 | 180K |
| R6 | 3K |
| R7 | 130K |
| R9, 12 | 100K |
| R10 | 3.6M |
| R11 | 10K |
| R13 | 56 Ohms |
| R15 | 3.3M |
| R16 | 510K |
| R17 | 16M |
| Primary winding 66 | 1200 turns of No. 32 gauge wire |
| Secondary winding 70 | 800 turns of No. 36 gauge wire |
| Core of transformer 68 | Ferrite |

OPERATION

On a call for heat, thermostat 38 closes its contacts, causing valve winding 32 to be energized to open valve 30. With valve 30 open, gas flows through conduits 22 and 26 to pilot burner 24. Concurrently, autotransformer 50 is energized, enabling its second winding portion 52 to provide a power source for energizing spark generating circuit 54. With second winding portion 52 energized, circuit 54 is energized as previously described to effect sparking between electrode 62 and pilot burner 24 to ignite the pilot burner gas.

Also occurring when thermostat 38 calls for heat is the energizing of oscillator A1. With oscillator A1 energized, a square wave signal at a frequency of 1500 Hz appears at its output pin 3. This signal, reduced in amplitude by resistor R8, appears on the emitter of transistor Q2. When the high portion of the signal exists, transistor Q2 is biased on through its emitter-base circuit; when the low portion of the signal exists, transistor Q2 is off. Thus transistor Q2 is turned on and off at the oscillator frequency of 1500 Hz.

Also occurring when thermostat 38 closes its contacts is charging of capacitor C6 through rectifier CR4. Specifically, when the top end of transformer secondary winding 10 is positive, capacitor 66 is charged through rectifier CR4, making the side of capacitor C6 connected to lead 64 positive. When the polarity reverses on transformer secondary winding 10, reverse charging of capacitor C6 is prevented by rectifier CR4. Capacitor C6 is prevented from discharging as will be hereinafter described, until transistor Q3 is biased on.

As previously described, the charging path for capacitors C7 and C8 is through the pilot burner flame 74. Therefore, in the absence of flame 74, the extremely high impedance of the air gap between flame probe 72 and pilot burner 24 prevents charging of capacitors C7 and C8. With capacitors C7 and C8 in an uncharged condition, transistor Q3 is unable to be biased into a conductive mode. Specifically, since capacitors C7 and C8 are connected across the emitter-base circuit of transistor Q3, transistor Q3 cannot be biased into conduction so long as capacitors C7 and C8 remain uncharged. Therefore, in the absence of flame 74, capacitors C7 and C8 remain uncharged and transistor Q3 remains non-conductive.

When transistor Q3 is non-conductive, no gating signal is available to transistor Q4 so that transistor Q4 is also non-conductive. With transistor Q4 non-conductive, no current can flow through primary winding 66 of coupling transformer 68. Under these conditions, secondary winding 70 of coupling transformer 68 remains de-energized, preventing energizing of relay winding 46. With relay winding 46 de-energized, relay contacts 40 and 42 remain open, preventing energizing of winding 36 of valve 34. Thus, in the absence of pilot burner flame 74, gas is prevented from flowing to main burner 20.

Under normal conditions, sparking between electrode 62 and pilot burner 24 will immediately ignite the pilot burner gas. When pilot burner flame 74 appears, capacitors C7 and C8 begin to charge. Because of flame rectification, the sides of capacitors C7 and C8 connected to lead 64 become charged positive. When the charge becomes sufficient, and sufficient current flows through resistors R10 and thermistor T1, and transistor Q2 is off, transistor Q3 is biased on.

Because the collector of transistor Q2 is connected to the base of transistor Q3, whenever transistor Q2 is on, the collector voltage of transistor Q2 becomes more positive, biasing transistor Q3 off, and whenever transistor Q2 is off, transistor Q3 can be biased on. Thus, transistor Q3 is biased on and off at the same oscillator frequency of 1500 Hz.

When transistor Q3 is on, it enables current flow through the emitter-collector circuit thereof into bias resistor R12 and the base-emitter circuit of transistor Q4, effecting the on-off operation of transistor Q4 at the same 1500 Hz frequency. The supply of such current flow is the transformer secondary winding 10 aided by the filtering action of capacitor C6.

When transistor Q4 is on, current flows through resistor R13, the parallel-connected capacitor C4 and primary winding 66, and the emitter-collector circuit of transistor Q4. Again, the current source is transformer secondary winding 10 aided by the filtering action of capacitor C6.

When transistor Q4 shuts off, the abrupt cessation of current flow through primary winding 66 causes a voltage to be induced in secondary winding 70. Each induced voltage pulse charges capacitor C5 and energizes relay winding 46. Between the induced voltage pulses, capacitor C5 is effective to maintain relay winding 46 energized.

When relay winding 46 is energized, it causes movable contact 42 to break from fixed contact 44 and make with fixed contact 40. Under this condition, spark generating circuit 54 is de-energized and valve winding 36 is energized. With valve winding 36 energized, valve 34 opens, allowing gas to flow to the main burner 20 for ignition by the pillot burner flame 74. Under normal operation, this condition exists until thermostat 38 opens its contacts, de-energizing the system.

A particular advantage of the system of the present invention is its immunity from the effects of false signals or noise which may be introduced into the circuitry. Specifically, relay winding 46 is energizable only upon application of sufficient power. This sufficient power can be obtained only if the frequency of the voltage pulses generated in coupling transformer 68 is within a specific frequency span encompassing 1500 Hz so as to effect sufficient power transfer from primary winding 66 to secondary winding 70. The values of capacitors C4 and C5 and windings 66 and 70 and the core of transformer 68 are chosen so that sufficient power to operate relay winding 46 is obtained only if the frequency of the on-off operation of transistor Q4 is between approximately 500 and 5000 Hz. It is noted that the most common false signals are signals of frequencies considerably lower than 500 Hz.

While the invention has been illustrated and described in detail in the drawing and foregoing description, it will be recognized that many changes and modifications will occur to those skilled in the art. It is therefore intended, by the appended claims, to cover any such changes and modifications as fall within the true spirit and scope of the invention.

I claim:

1. In a gas burner control system wherein a main burner is ignited by a pilot burner, wherein the pilot burner is ignited upon a call for heat, and wherein gas flow to the main burner is prevented until a pilot burner flame exists, the improvement comprising:

an oscillator having an input connected to a power source so as to be energized thereby upon a call for heat and maintained energized thereby as long as said call for heat exists, and an output having a high frequency signal appreciably higher than 60 Hz;

solid-state switch means connected to said output of said oscillator;

capacitor means connected to said switch means and operative, when sufficiently charged, for effecting on-off operation of said switch means at the frequency of said high frequency output signal of said oscillator;

coupling circuit means including a transformer having a primary winding connected in circuit with said switch means and a secondary winding connected in circuit with means for controlling the gas flow to the main burner, said coupling circuit means being effective to enable sufficient energizing of said means for controlling the gas flow to the main burner only when said frequency of said on-off operation of said switch means is within a predetermined frequency span; and flame responsive means connected to said capacitor means for effecting said sufficient charging of said capacitor means only when the pilot burner flame exists.

2. The control system claimed in claim 1 wherein said frequency of said on-off operation of said switch means is between 500 and 5000 Hz.

3. The control system claimed in claim 1 wherein said capacitor means comprises two capacitors connected in parallel.

4. The control system claimed in claim 1 wherein said coupling circuit means further includes a capacitor connected across said primary winding and a capacitor and controlled rectifier connected in series across said secondary winding.

5. The control system claimed in claim 1 wherein said switch means includes first, second, and third transistors, each of said transistors having a base, emitter, and collector, said first transistor having its emitter connected to said output of said oscillator and its collector connected to the base of said second transistor, said second transistor having its emitter connected to one side of said capacitor means, its base connected to an opposite side of said capacitor means, and its collector connected to the base of said third transistor, said third transistor having its emitter-collector circuit connected in series with said primary winding of said transformer.

6. The control system claimed in claim 5 further including a series-connected fixed resistor and a thermistor connected in parallel with the emitter-base circuit of said second transistor, said thermistor being an NTC type and effective to enable adequate biasing current flow through said emitter-base circuit of said second transistor at low ambient temperatures.

7. The control system claimed in claim 1 wherein said means for controlling the gas flow to the main burner includes a relay having a winding and normally-open contacts and a valve connected fluidically in series with said main burner and having a winding, said relay winding being connected in circuit with said secondary winding of said transformer, and said valve winding being connected to said power source through said normally-open relay contacts so as to be energized to allow gas to flow to said main burner when said normally-open relay contacts are closed.

8. The control system claimed in claim 7 further including spark generating circuit means for igniting the pilot burner, an autotransformer connected to said power source for providing power to said spark generating circuit means, and said relay further including normally-closed contacts for connecting said spark generating circuit means to said autotransformer.

9. In a gas burner control system, a pilot burner;

a main burner disposed to be ignited by said pilot burner;

a source of electrical power;

a first valve for controlling the flow of gas to said pilot burner;

a second valve connected fluidically in series with said first valve for controlling the flow of gas to said main burner;

electrically operated means for controlling operation of said first valve including a winding adapted to be energized by said power source upon a call for heat to allow gas to flow to said pilot burner;

electrically operated means for controlling operation of said second valve including a winding;

voltage step-up means adapted to be energized by said power source upon said call for heat;

a relay having a winding and normally-closed and normally-open contacts;

spark generating circuit means energized by said voltage step-up means through said normally-closed relay contacts for igniting said pilot burner;

capacitor means adapted to be charged by rectified current flow through pilot burner flame;

an oscillator adapted to be energized by said power source upon said call for heat and maintained energized thereby as long as said call for heat exists, and having a high frequency output signal;

solid-state switch means connected to said oscillator and said capacitor means and responsive to a sufficient charging of said capacitor means for effecting on-off operation of said switch means at the frequency of said high frequency output signal of said oscillator; and coupling circuit means including a transformer having a primary winding connected in circuit with said switch means and a secondary winding connected in circuit with said relay winding, said coupling circuit means being effective to enable sufficient energizing of said relay winding to enable said normally-closed contacts to open and said normally-open contacts to close only when said frequency of said on-off operation of said switch means is within a predetermined frequency span, said normally-open contacts, when closed, connecting said winding of said second valve to said power source to allow gas to flow to said main burner.

10. The control system claimed in claim 9 wherein said voltage step-up means comprises an autotransformer.

11. In a gas burner control system, a pilot burner;

a main burner positioned to be ignited by said pilot burner;

first valve means, activated upon a call for heat, for effecting flow of gas to said pilot burner;

spark generating circuit means, energized upon said call for heat, for establishing a pilot burner flame;

capacitor means charged in response to current flow through said pilot burner flame;

an oscillator adapted to be immediately energized by a power source upon said call for heat and to be maintained energized by said power source as long as said call for heat exists, and having an output signal of a frequency substantially greater than 60 Hz;

solid-state switch means responsive to said output signal and said capacitor means, when charged, for providing on-off switching at the same frequency as that of said oscillator output signal;

second valve means for controlling flow of gas to said main burner and including valve control circuit means responsive to sufficient applied power for effecting said flow of gas to said main burner; and coupling circuit means including a transformer having a primary winding in circuit with said switch means and a secondary winding in circuit with said valve control circuit means, said sufficient applied power being provided only when said frequency of said on-off switching is within a predetermined span.

12. The control system of claim 11 wherein said frequency of said output signal is approximately 1500 Hz, and said predetermined span is 500 to 5000 Hz.

* * * * *